United States Patent [19]

Kordak

[11] Patent Number: 4,736,585

[45] Date of Patent: Apr. 12, 1988

[54] HYDROSTATIC MACHINE

[75] Inventor: Rolf Kordak, Lohr/Main, Fed. Rep. of Germany

[73] Assignee: Mannesmann Rexroth GmbH, Fed. Rep. of Germany

[21] Appl. No.: 838,145

[22] Filed: Mar. 10, 1986

[30] Foreign Application Priority Data

Mar. 15, 1985 [DE] Fed. Rep. of Germany ..... 3509481
Jul. 13, 1985 [DE] Fed. Rep. of Germany ..... 3525097

[51] Int. Cl.[4] ..... F15B 31/04; B21B 35/00

[52] U.S. Cl. ..... 60/452; 60/459; 72/28; 72/249

[58] Field of Search ..... 72/245, 243, 241, 249, 72/20, 28; 60/452, 459, 460; 91/31

[56] References Cited

U.S. PATENT DOCUMENTS

| | | | |
|---|---|---|---|
| 2,685,276 | 8/1954 | Dyken | 91/31 |
| 2,999,482 | 9/1961 | Bower | 91/31 |
| 3,693,385 | 9/1972 | Fujino et al. | 72/28 X |
| 3,762,198 | 10/1973 | Bair | 72/28 |
| 4,014,198 | 3/1977 | Herrmann | 72/249 |
| 4,116,001 | 9/1978 | Orth | 60/459 |
| 4,134,283 | 1/1979 | Noé | 72/20 X |

FOREIGN PATENT DOCUMENTS

| | | | |
|---|---|---|---|
| 2260915 | 6/1974 | Fed. Rep. of Germany . | |
| 2038037 | 7/1980 | United Kingdom | 72/245 |
| 0937069 | 6/1982 | U.S.S.R. | 72/241 |

OTHER PUBLICATIONS

Energieeinsparung, Jan. 1983, entitled "Hydrostatische Fahrantriebe Mit Energiespeicherung, pp. 97-102.

*Primary Examiner*—Robert L. Spruill
*Assistant Examiner*—Steve Katz
*Attorney, Agent, or Firm*—Harness, Dickey & Pierce

[57] ABSTRACT

An adjustable hydrostatic machine is connected to a pressure line with impressed system pressure. The pressure difference applied at the machine is set at a control valve so that the stroke volume of the machine in idling operation is set to an adjustment belonging to a predetermined load torque. In idling operation the machine is thus operated at large stroke volume with small pressure difference. If it is then necessary to furnish the load torque a switching valve is opened so that at the machine the full pressure difference is immediately applied, the machine can furnish the desired torque and the time loss necessary for setting the machine is eliminated.

10 Claims, 1 Drawing Sheet

HYDROSTATIC MACHINE

BACKGROUND OF THE INVENTION

The invention relates to a hydrostatic machine comprising an adjusting means for adjusting the displacement or absorption volume.

Fundamentally, the adjusting means of a hydrostatic machine, for example an axial piston machine, has a certain inertia which proves to be disadvantageous in particular when the machine is suddenly subjected to a load. The adjusting means adjusts the displacement or absorption volume of the machine in the shortest possible time to the greatest possible value to avoid an excessive drop in speed, whereupon the adjustment of the machine is returned to a value necessary for the steady state condition, i.e. when the machine is loaded with a certain torque and is to maintain a certain speed of rotation. Due to its construction the setting time in which after the application of a load torque the nominal speed of the machine is again reached is relatively long with a hydrostatic machine.

The problem underlying the invention is therefore to shorten the settling time of a hydrostatic machine.

SUMMARY OF THE INVENTION

This problem is solved with the features set forth in the characterizing clause of the claim.

Since therefore the adjusting means of the machine even before occurrence of the load torque is in the position corresponding to the load torque the settling time is greatly shortened when on occurrence of the torque the switching valve is switched to the through position. The time loss for actuation of the adjusting means is thus compensated.

BRIEF DESCRIPTION OF THE DRAWINGS

Examples of embodiment of the invention are explained hereinafter with the aid of the drawings, wherein.

DETAILED DESCRIPTION OF THE PREFERRED EMBODIMENTS OF THE INVENTION

Figure 1:
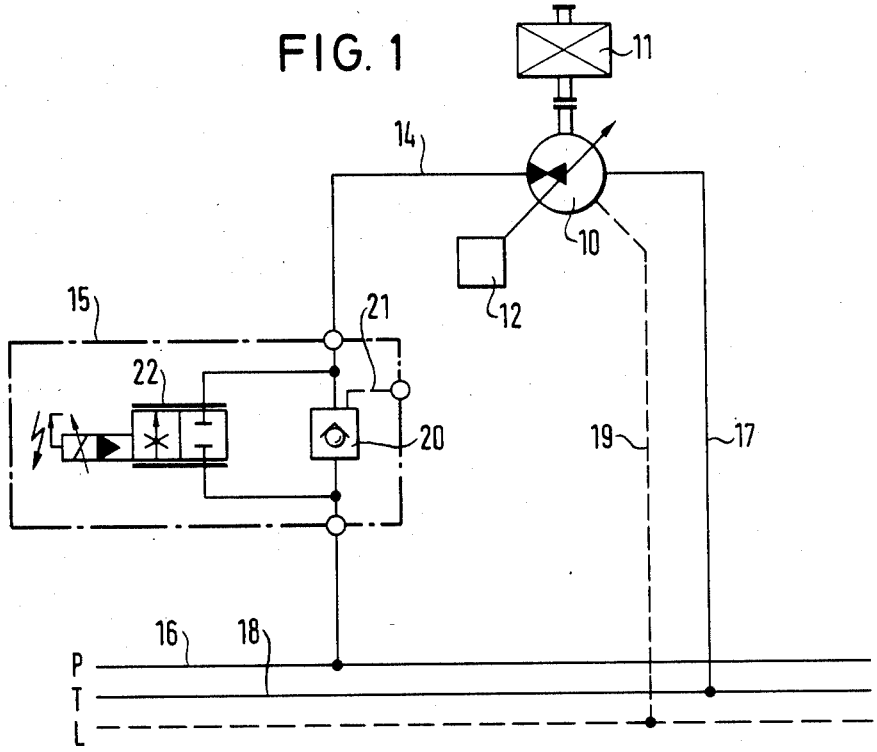
FIG. 1 shows a valve arrangement having a flow control valve for an axial piston machine for driving a roll stand.

An axial piston machine 10 drives via a gearing 11 the two rolls, not illustrated, of a roll stand. In the rolling operation it is important that the material whose crossection is reduced between the rolls is led as far as possible free of tension and without upsetting over the roll stand since otherwise loss of quality must be accepted. High requirements are thus made of the dynamics of the drive.

The adjusting means 12 of the axial piston machine 10 is a known unit with which the pivot angle and thus the absorption volume of the motor 10 can be adjusted. On the pressure side the motor 10 is connected via a line 14 and a valve block 15 to a pressure line 16 with an impressed system pressure P. On the discharge side the motor is connected via a line 17 to a line 18 leading to the tank T or to a low-pressure line. 19 denotes a leakage oil line.

The control block comprises a switching valve 20 which is arranged in the supply line 14. The switching valve 20 is a check valve which is switchable by a pressure signal in the control line 21 into the through position.

Arranged in parallel to the switching valve 20 is an electrically drivable flow control valve 22.

In idling operation of the motor 10 in which the latter merely drives the rolls of the stand the switching valve 20 is switched to the blocking position and the control valve 22 is brought into the throttling position. Pressure obtaining in the line 14 between the control block 15 and the motor 10 is reduced towards the tank. The motor 10 receives on the pressure side the fluid quantity set at the control valve 22 at relatively low pressure. Thus, the adjusting means 12 must increase the absorption volume of the motor 10 to develop the idling torque. The adjustment is carried out in known manner in dependence upon the inlet pressure of the machine or in dependence upon the pressure difference at the machine.

By means of the setting of the control valve 22 in this manner the absorption volume of the motor 10 is brought to a value which it must have during the steady state condition with material between the rolls. This absorption volume and the corresponding pivot angle of the machine can be previously determined and are thus known.

If now a torque surge occurs when the material to be rolled enters the roll gap, only the switching valve 20 will be switched to the through position and the motor 10 receives the full fluid flow. Consequently, not time is lost for setting the motor 10 from idling to load operation.

On actuating the switching valve 20 the absorption volume of the axial piston machine and thus its pivot angle are changed only slightly. The settling time for the speed on applying the torque is very greatly reduced. The control block 15 is preferably mounted directly on the pressure flange of the axial piston engine 10. With the switching valve 20 the machine 10 may moreover be disconnected from the pressure line 16 to interrupt the energy supply for example on an emergency stop. The machine can then still work as a generator and apply energy via the opening check valve to the pressure line 16.

Instead of the flow control valve pressure valves could also be provided which avoid the disadvantage that on a stroke adjustment of the machine, i.e. a pivot angle change of the axial piston machine, the pressure difference at the flow control valve and thus the throughflow also change. For this reason the control is stabilized with pressure valves and the pressure coupling of the secondary controlled system taken into account whilst a flow valve only takes acount of the flow coupling.

Figure 2:
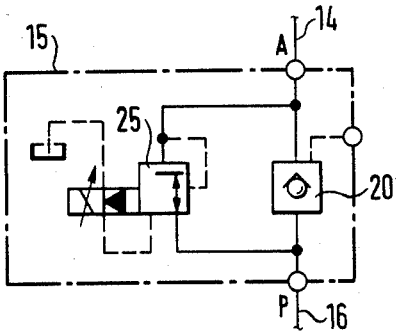
FIG. 2 is a valve arrangement with a pressure reducing valve and FIG. 3 is a valve arrangement with a pressure limiting valve.

In FIG. 2 in the control block 15 parallel to the switching valve 20 there is an electrically adjustable pilotcontrolled pressure-reducing valve 25. With the pressurereducing valve the operating pressure A in the line 14 and thus in the connection line of the machine 10 is limited. The pressure in the line 14 is thus reduced to a lower value than the system pressure in the line 16 so that the machine 10 is offered a smaller pressure difference when in idling operation the switching valve 20 is switched to the blocking position. The machine 10 thus pivots out in order to cover the torque requirement in idling at the smaller pressure difference. The reduced pressure in the line 14 is set at the pressure-reducing valve 25 in such a manner that the adjusting means of the machine sets a stroke volume which the machine requires to produce the necessary load torque when the switching valve 20 is opened and thus the full operating pressure present at the machine 10. The stroke volume of the machine 10 and thus its pivot angle changes either not at all or only very slightly. Thus, not only is the time loss for the pivot operation on occurrence of the torque surge compensated but the control is also stabilized.

Figure 3:
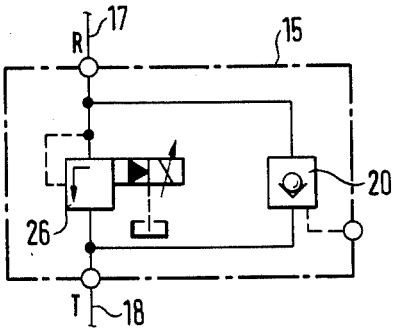

A modified embodiment is shown in FIG. 3 in which a pressure-limiting valve 26 is connected into the output line 17 of the machine leading to the tank line 18. With this valve when the switching valve 20 is blocked at the connection R of the valve block 15 an operating pressure is set and thus at the machine 10 a pressure difference which suffices to cover the torque requirement of the machine in idling when the latter is set by the adjusting means 12 to the stroke volume necessary for producing the load torque when the switching valve 20 is opened and thus the full pressure difference effective at the machine 10.

I claim:

1. Hydrostatic machine comprising an adjusting means for adjusting the displacment or absorption volume of said machine in response to a pressure condition for maintaining a predetermined machine output, comprising a connection line between said machine to each of a high-pressure line and a low-pressure line, characterized in valve means for controlling the flow through one of said connection lines to provide a first restricted flow when said valve means is in a first position during idling operation of said machine for effecting said adjusting means of said machine to set the displacement or absorption volume thereof to a value corresponding to a predetermined load torque, said valve means being operable to a second position for providing substantially unrestricted flow through said one connection line on occurrence of the predetermined load torque for immediately effecting that load torque output from said machine without necessitating resetting of said adjusting means.

2. A hydrostatic machine as set forth in claim 1 wherein the valve means comprises a switching valve movable between a closed position for preventing flow and an open position for permitting unrestricted flow and a parallel control valve for permitting restricted flow.

3. Hydrostatic machine according to claim 2, characterized in that the switching valve is a controlled check valve opening in the direction towards the high pressure line with impressed system pressure.

4. Hydrostatic machine according to claim 2, characterized in that the control valve is electrically operable.

5. Hydrostatic machine according to claim 2, characterized in that the control valve is a flow control valve in the connection line connected to the pressure line.

6. A hydrostatic machine as set forth in claim 5 wherein the control valve is electrically operated.

7. Hydrostatic machine according to claim 2, characterized in that the control valve is a pressure-reducing valve in the connection line connected to the pressure line.

8. A hydrostatic machine as set forth in claim 7 wherein the control valve is electrically operated.

9. Hydrostatic machine according to claim 2, characterized in that the control valve is a pressure-limiting valve in the connection line connected to the low-pressure line.

10. A hydrostatic machine as set forth in claim 9 wherein the control valve is electrically operated.

* * * * *